United States Patent [19]

Wada

[11] 3,936,061

[45] Feb. 3, 1976

[54] ROLLER SKATE

[75] Inventor: Nobuhito Wada, Tokyo, Japan

[73] Assignee: Mahmut Starkow, Tokyo, Japan

[22] Filed: Apr. 5, 1974

[21] Appl. No.: 458,397

[52] U.S. Cl. ..... 280/11.23; 301/5.7; 280/11.26

[51] Int. Cl.[2] ..... A63C 17/06

[58] Field of Search..... 280/11.23, 11.22, 11.26, 280/11.25, 11.19, 11.1 R; 301/5.3, 5.7

[56] References Cited

UNITED STATES PATENTS

| | | | |
|---|---|---|---|
| 700,377 | 5/1902 | Sakrzewski | 280/11.23 X |
| 1,487,966 | 3/1924 | Miller-Metcalf | 280/11.22 |
| 1,606,902 | 11/1926 | Shoemaker | 280/11.26 |
| 1,846,265 | 2/1932 | Lang | 280/11.23 |
| 1,989,344 | 1/1935 | Tracey | 280/11.26 |
| 2,529,314 | 11/1950 | Schmid | 280/11.23 |
| 2,559,118 | 7/1951 | Foran | 280/11.23 |
| 3,396,985 | 8/1968 | Kipnis | 280/11.26 |

FOREIGN PATENTS OR APPLICATIONS

| | | | |
|---|---|---|---|
| 229,745 | 2/1925 | United Kingdom | 301/5.7 |
| 741,159 | 11/1955 | United Kingdom | 280/11.23 |
| 1,002,311 | 8/1965 | United Kingdom | 301/5.3 |

*Primary Examiner*—M. H. Wood, Jr.
*Assistant Examiner*—Milton L. Smith
*Attorney, Agent, or Firm*—Haseltine, Lake & Waters

[57] ABSTRACT

A roller skate, of the type of two-rollers, wherein two substantially spherical rotary elements are rotatably mounted on a support or chassis along its longitudinal axis, to give the feeling of ice skating to users.

3 Claims, 9 Drawing Figures

ROLLER SKATE

The present invention relates to a roller skate, and more particularly to a type having only two rollers or rotary elements for each support chassis.

The roller skates hither to generally marketed and used are all of the four-roller type. Although they have been varying designs, all of them are provided with two pairs of rollers, each rotatably mounted on a support at front and rear portions thereof, each of which rollers is of cylindrical configuration of small diameter and width. Due to such configuration, number and arrangement of the rollers or the rotary elements, skating according to such conventional roller skates might be stable, but it is difficult for the skater to sharply turn and do perform intricate movements as in ice skating. This means, on the one hand, that a relatively vast space is required for enjoying skating with the conventional four-roller skates. This limitation possibly constitutes one of the problems which have prevented the spread of the roller skating, particularly in cities. On the other hand, difficulty or rather impossibility of making intricate movements might not have attracted elder youths or adults.

The rotary element for the skates has been made of cast iron or steel, but recently a synthetic resin has been used so as to decrease noise. Despite that, due to configuration of the narrow width and small diameter cylinder and number of the rollers which cause increase of the contact area with the skating floor, such noise is still inevitable. This noise problem also would have been an obstacle to making roller skating an attractive sport like ice skating.

For similar reasons, there is the problem of vibration transmitted to the feet of the skater with the conventional four-roller skates. It might be possible and actually has been proposed that such vibration be eliminated by interposing an elastically buffering piece between each of the roller members and the support, but this would cause further increase of the parts to be assembled which requires more labor and raises cost.

In the conventional four-roller skates, special shoes have often been used, each of which is generally attached to the support chassis, for instance, by means of screws. There has also been known another type of four-roller skates provided with belt means for readily binding ordinary shoes to be attached to each of the supports. Due to configuration, number and arrangement of the rollers referred to above, when the skater intends to make a sharp turn using such skates, a fairly large force is to imparted to said binding means, which imparts shock to ankle or other portions of the foot where said belt means bind the shoe to the skate and loosens said binding, which in turn makes a quick change of the skating direction more difficult.

The object of the present invention is to provide a new type of roller skate which overcomes and obviates the difficulties inevitable with the conventional four-roller skates as referred to above.

Another object is to provide roller skate capable of giving to the skater feelings similar to ice skating.

An additional object of the present invention is to provide skates of simple construction and consequently easily assembled.

A further object is to provide skates with which the skater may sharply turn and make intricate movements as in ice skating.

Still another object is to provide skates to which the ordinary shoe may be bindingly attached so that the skater may always skate holding perfect attachment of the shoe to the skates.

The above and other objects as well as various advantages to be understood by reading through the specification can be attained according to the present invention by providing a roller skate which comprises a support chassis, two rotary elements each of which is of substantially spherical configuration, and means for rotatably mounting each of said rotary elements on said support chassis so as to be arranged along its longitudinal axis, whereby the rotary elements contact the skating surface over a fairly narrow area.

The present invention will now be further explained in more detail with reference to some embodiments illustrated, as mere examples, in the drawings.

Figure 1:
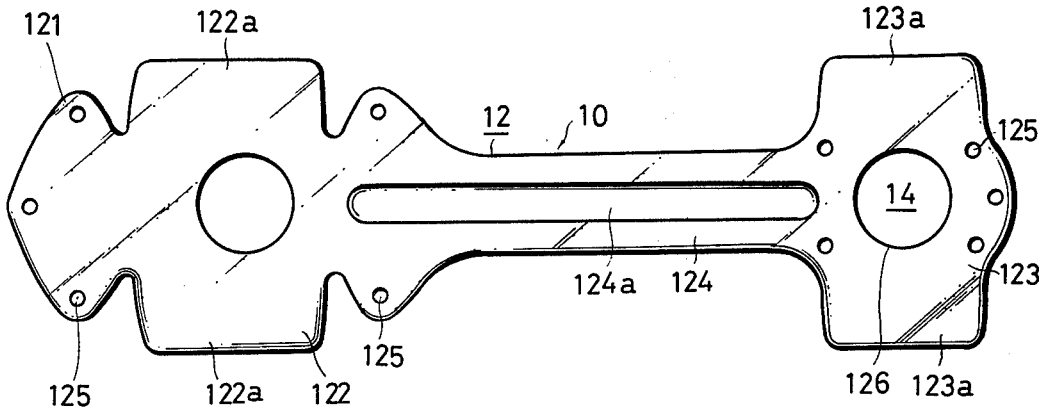
FIG. 1 shows a plan view of a roller skate in accordance with the present invention.
Figure 2:
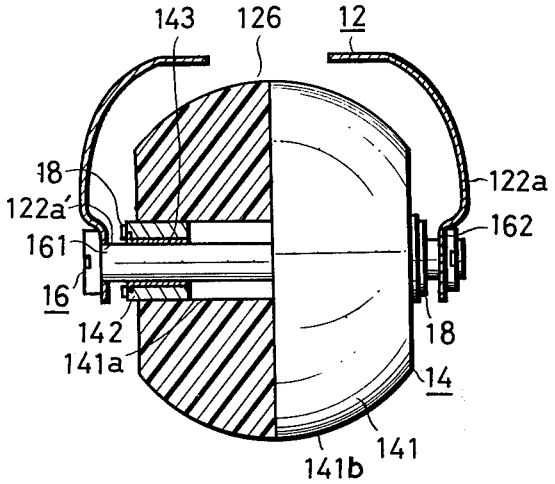
FIG. 2 shows an enlarged partial cross section of the roller skate in FIG. 1, to show the structure of a rotary element.

In the drawings, FIGS. 1 and 2 show a basic embodiment of the roller skate in accordance with the present invention. A roller skate body 10, which should be secured to a bottom of shoes expressly provided therefor (not shown) by means of suitable attaching means, comprises a support or chassis 12, two rotary elements 14 and means 16 for rotatably mounting each element 14 on the chassis 12. The chassis 12 which may be made of steel or rigid material comprises a front section 121 to which a stopping element (not shown), for instance, a rubber block, may be secured by means of a suitable securing means, a front rotary element accomodating section 122 which has a pair of curved descending side walls 122*a*, a rear rotary element accomodating section 123 which has a pair of curved descending side walls 123*a*, and a middle section 124 for integrally connecting the two accomodating sections 122 and 123 together. In the chassis, there are provided apertures or openings 125 in each of which a bolt (not shown) may be inserted and secured with a nut to connect or incorporate the chassis to the shoes for exclusive use and to mount the stopping element to the front end of the chassis. To decrease the weight of the chassis 12, an opening or openings 126 may be formed at suitable portions thereof, for instance, central portions of the accomodating sections 122, 123, as long as the required strength of the chassis can be maintained. At the connecting section 124 which may be made narrower than the other sections to decrease the weight of the chassis, an elongated cavity 124*a* may be formed through its whole length to provide strength.

As shown in FIG. 2, the rotary element 14 has a spherical or semi-spherical appearance and comprises a body 141 with a central bore 141*a*, which is made of an elastic and relatively hard material with anti-frictional properties and resistance to abrasion, such as a synthetic plastic material, for instance, Nylon or EVA (ethylene-vinylacetate copolymer) resin, or a synthetic hard rubber, a collar or sleeve 142 inserted in the bore 141*a* and made of a hard material, for instance, Nylon or ABS (acrylonitrile-butadienestyrene copolymer) resin, and an oilless bearing 143 inserted in the sleeve 142 and made of a graphite-containing alloy, for instance, consisting of 89% copper, 9.75% tin and 1.25% graphite. Each of the elements 14 is rotatably mounted on a bolt 161 which is inserted through an opening 122*a'* formed in the curved wall 122*a* at a portion near the free end thereof and fixedly supported by the curved wall with the aid of a nut 162. Between the inner surface of the curved wall 122*a* and the outer end surface of the bearing 143, O-rings 18 as spacers are mounted on the bolt 161. The outer curved surface 141*b* as running surface of the substantially spherical element body 141 makes contact with the skating floor over a relatively small area during skating and thus the skating resistance of the roller skate according to the present invention is quite low, in comparison with the conventional one of four rollers each of which is a short cylinder so that the contact area is relatively large. In order to reduce the skating resistance, however, an annular ridge (not shown) may be formed at the top or center portion of the curved surface 141*a*.

Figure 3:
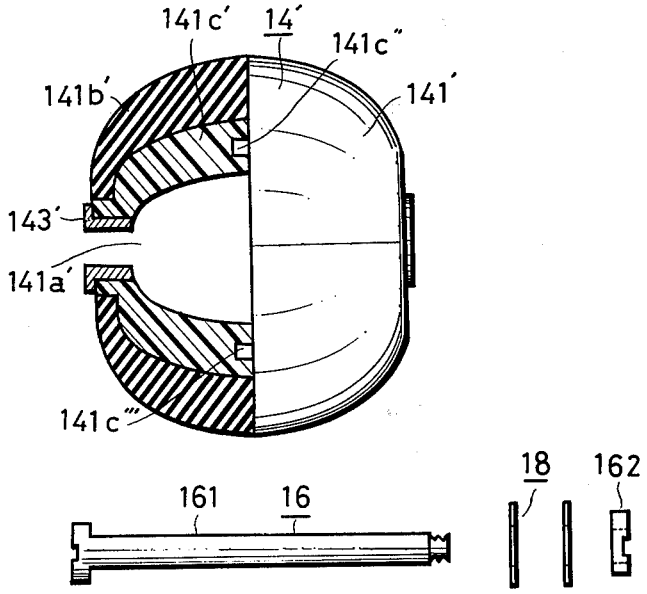
FIG. 3 shows another type rotary element and means for attaching the element to the support or chassis for the roller skate as shown in FIG. 1.

FIG. 3 shows another embodiment of the rotary element and means for attaching the element to the chassis as shown in FIG. 1. The attaching means 16 and O-rings 18 as spacers are the same as those illustrated in FIG. 2. The element 14' comprises a body 141' with a central bore 141*a'* and two bearings 143' which are oilless as illustrated and stated above in connection with FIG. 2. The body 141' consists of an outer member 141*b'* made of EVA resin or a synthetic rubber and an inner member 141*c'* which combines two cup-like members connectable to each other by means of several projections 141*c''* formed on one of the cup member and of blind bores 141*c'''* formed in the other cup member, said cup members being made of a hard synthetic resin, such as ABS, polypropylene or polyethylene resin.

The element 14' may be manufactured in a manner as shown in the following. In the first place, two cup members with the bearings are manufactured by injection moulding ABS resin at a temperature higher than 250°C. The resulting cup members are then combined by inserting the projections formed on one of the cup members into the bores formed in the other cup member. For the combined cup member, a melted polymer solution for synthetic rubber is supplied by injection, by using the combined cup member as the insert, and then leaving it for cooling to manufacture the element.

Figure 4:
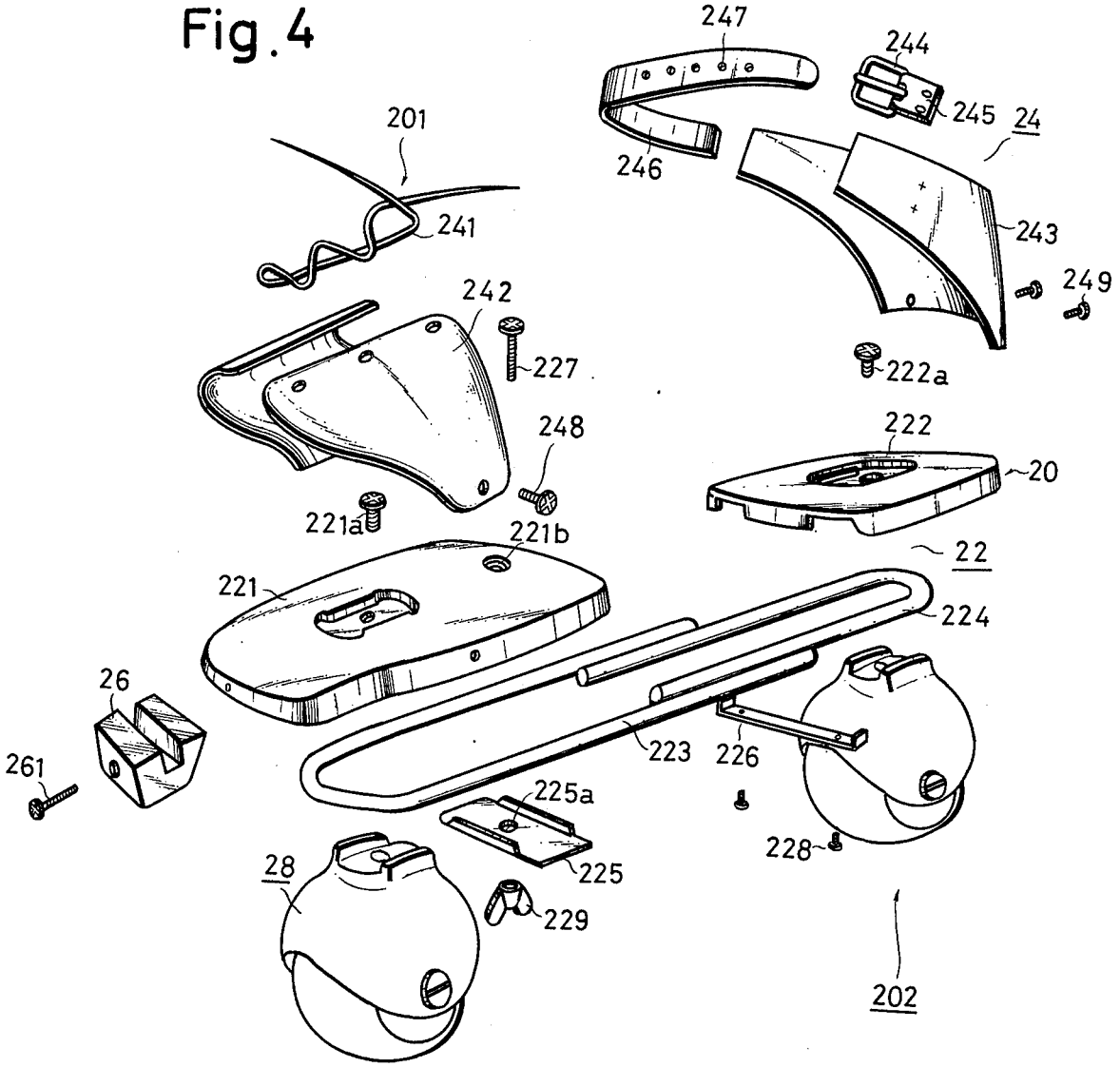
FIG. 4 is an exploded perspective view of another embodiment of the roller skate according to the present invention.

FIG. 4 shows a second embodiment of the roller skate in accordance with the present invention, which may be used for skating with ordinary shoes or without any shoes. The roller skate generally designated by reference numeral 20 comprises a chassis or support 22, band means 24 secured to the chassis 22 to put on the roller skate 20, a stopper 26 such as a rubber block to be mounted on the chassis 20 at front end, and two roller members 28 to be secured to the chassis 22. The band means 24 consists of a first member with a string 241 and two sheet members 242 connectable to each other by the string 241 to support an instep of the foot and a second member with a main part 243, a buckle 244, a member 245 for connecting the buckle 244 to the main part 243 and a strip 246 having a large number of holes 247 and to be secured to the main part 243, to support an ankle. The chassis 22 comprises a first section 221 to which the first band member and one of the roller members 28 are secured, a second section 222 to which the main part 243 of the second band member and the other roller member are secured, two U-shaped rods 223, 224 each of which is inserted in the first section 221 or second section 222, respectively and interposed between the first section 221 or second section 222 and one of the roller members 28, and means 225, 226 for stably securing the rods 223, 224 to the first and second sections 221, 222.

Figure 5:
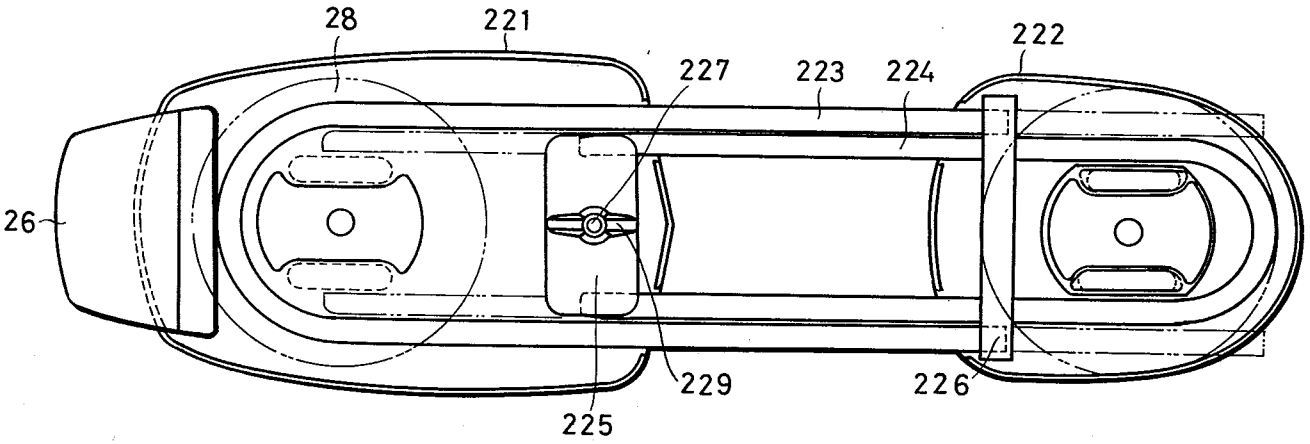
FIG. 5 is a bottom view of the roller skate shown in FIG. 4, to especially show size adjusting members therefor.

As evident from FIGS. 4 and 5, the first and second band members are secured to the side portion of the first and second sections 221, 222 of the chassis 22, respectively, by means of screws 248, 249. The stopper 26 is secured to the free end of the first section 221, by means of a screw 261. Each roller member 28 is secured on the bottom side of the first and second sections 221, 222, respectively, by means of screws 221*a*, 222*a*. In the first section 221, one of the U-shaped rod 223 is accomodated, while the other U-shaped rod 224 is accomodated in the second section 222. Note that, at this constructing step, the roller skate 20 consists of two separate members, a front part 201 and a rear part 202.

Both parts 201 and 202 can be securely connected by using the securing means 225, 226, screws 227, 228 and a nut 229, after the space between the first and second sections 221, 222 has been slidingly adjusted. The screw 227 extends through a hole 221*b* formed in the first section, a space defined by the oppositely arranged U-shape rods 223, 224, and a opening 225*a* formed in one of the securing means 225 and is secured by the nut 229. The securing means 225 presses the rod 224 toward the bottom side of the first section 221, by means of the screw-nut assembly 227, 229. The other securing means 226 is secured to the second section 222 by the screws 228, through the rods 223, 224, to press the rods toward the bottom side of the second section 222. The roller member 28 will be explained hereinafter, with reference to FIG. 6.

The roller skate 20 shown in FIGS. 4 and 5 has advantages in that no special shoes are required to make the enjoyment of skating easy and that the size of the roller skate can be changed freely by use of a common tool, for instance, a screwdriver to release and tighten the screws 228. The first and second sections 221 and 222 as well as the rods 223, 224 will be manufactured using a metallic rigid material, such as steel, cast iron or iron containing alloy, but if its strength allows, a synthetic plastic material may be employed, for reinforcing the same, if necessary.

Figure 6:
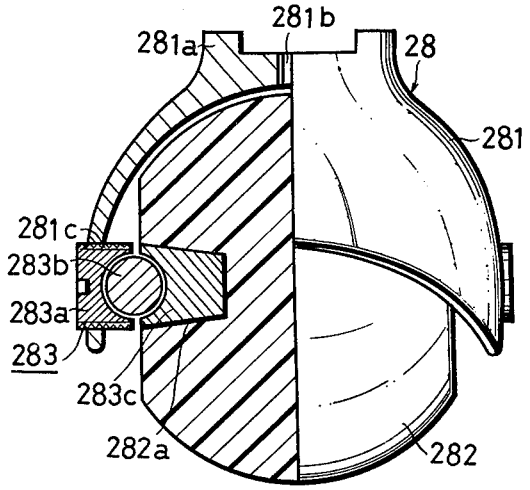
FIGS. 6 and 7 show enlarged partial sections of other types of rotary or running element, which may be employed for the roller skate shown in FIG. 4.

FIG. 6 shows a roller member 28 which may be employed for the roller skate shown in FIGS. 4 and 5. The roller member 28 comprises a cover member 281, a rotary or running element 282, and a support 283 to rotatably connect the element 282 to the cover member 281. The cover member 281 made of a metallic material or a synthetic plastic material with high strength, for instance ABS resin, covers the upper portion of the element 282 and has two ridged portions 281*a* which fit into cavities formed in the bottom side of the first section 221 or the second section 222 of the chassis 22 (FIGS. 4 and 5), a threaded hole 281*b* which is located between the ridges 281*a* and accomodates the screw 221*a* (FIG. 4) to secure the cover member 281 to the first section, and two threaded holes 281*c* which face each other at portions near the free end of the cover member 281 to accomodate the support 283. The support 283 consists of three members of a cylindrical lid 283*a* with an outer thread and inner cavity, a ball 283*b* and a truncated cone-like member 283*c* with an outer cavity and located in a corresponding truncated cone-like cavity 282*a* formed in the rotary element 282. The members 283*a*, 283*b* and 283*c* can be manufactured from a metallic material but, if the cover member 281 and the element 282 are manufactured from the synthetic plastic material, the members may also be made of a synthetic plastic material with a relatively high impact strength, such as Nylon resin. The rotary element 282 may be made of a hard synthetic or natural rubber, EVA or other synthetic resin, or the like.

Figure 7:
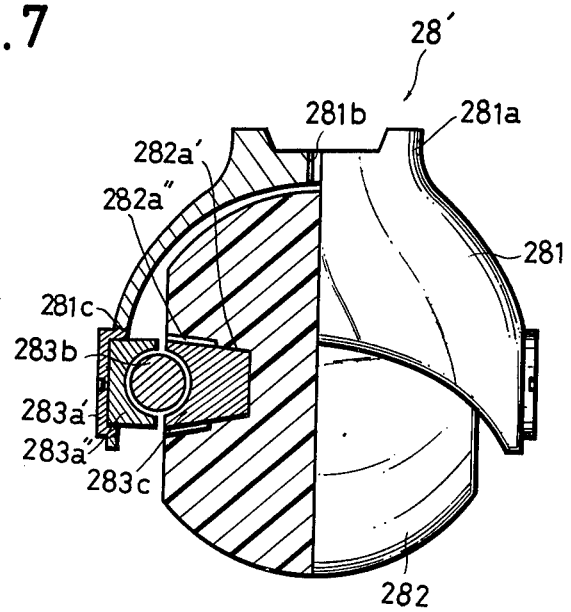

FIG. 7 shows a modification of the roller member shown in FIG. 6. The roller member 28' shown in FIG. 7 is different from that in FIG. 6 in that the lid member 283*a* shown in FIG. 6 is separated into two members of a lid 283*a'* with an outer thread mating with the internal thread of the hole 281*c* formed in the cover member 281 and a holding member 283*a''* with an inner cavity, and that a cavity 282*a'* which corresponds to the cavity 282*a* formed in the rotary element 282 and accomodates the truncated cone-like member 283*c* in FIG. 6 has a stepped portion 282*a''*. Due to the presence of the stepped portion 282*a''*, the diameter of the open end area of the cavity 282*a'* is made larger than that of the larger end area of the truncated cone-like member 283*c*. This means that, during roller skating, especially in turning, the member 283*c* can somewhat singularly move to make the required minimum radius of rotation as short as possible.

Figure 8:
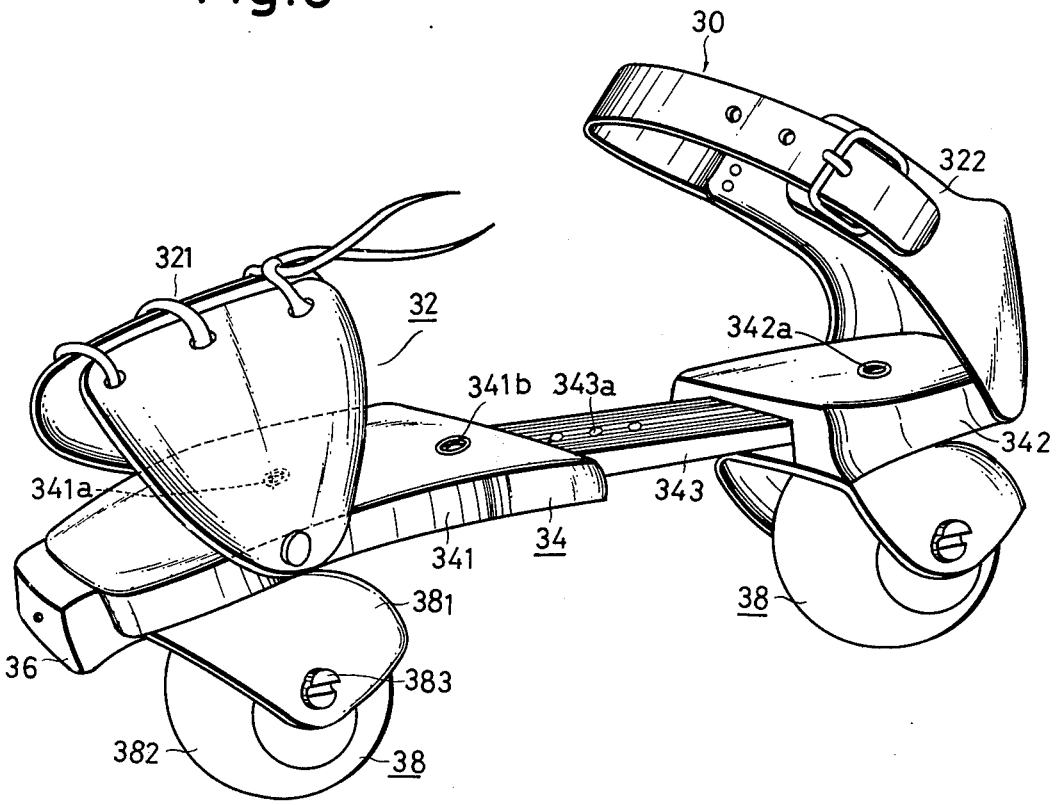
FIG. 8 shows a perspective view of another embodiment of the roller skate in accordance with the present invention.
Figure 9:
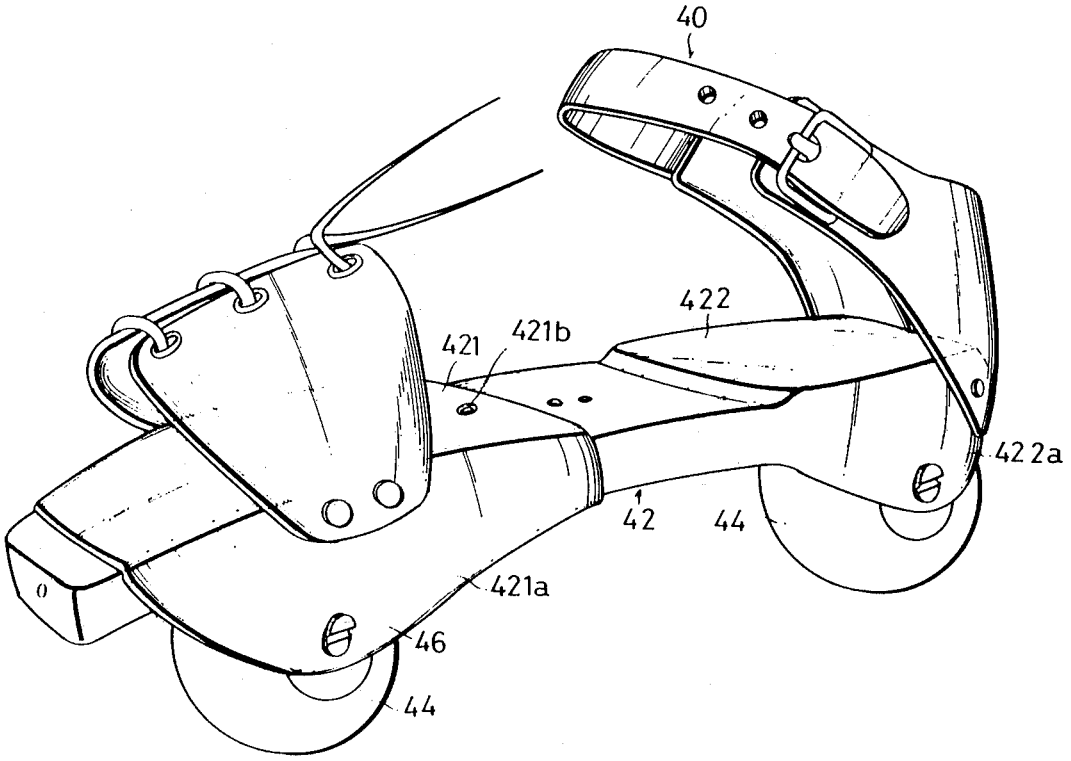
FIG. 9 shows a perspective view of a another embodiment of the roller skate in accordance with the present invention.

FIGS. 8 and 9 show the third and fourth embodiments of the roller skate according to the present invention. The roller skates 30 and 40 may be adjusted in size, in accordance with the foot size of the user.

The roller skate 30 shown in FIG. 8 comprises a band means 32 with two parts 321 and 322, a chassis 34, a stopper 36 secured at the front end of the chassis 34, and two roller members 38 secured at the bottom side of the chassis 34. The chassis 36 is similar to that shown in FIGS. 4 and 5 but different in that a plate-like member 343 with several threaded holes 343*a* arranged along the longitudinal center line of the plate member 343 is provided in lieu of the U-shape rods 223, 224 to detachably connect a first section 341 to a second section 342. Each of the roller members 38 comprises a cover member 381, a rotary or running element 382 and a means 383 for rotatably mounting the element 382 to the cover member 381. The roller member 38 may have a structure similar to the roller member 28 (FIG. 6) or 28' (FIG. 7), but the rotary element 382 and the element mounting means 383 thereof may be those illustrated and designated by reference numerals 14, 16 in FIG. 2 or 14', 16 in FIG. 3.

The roller members 38, especially cover members thereof are secured to the first and second sections 341, 342, respectively, using fastening means means 341*a*, 342*a*, such as screws. One end of the plate member 343 is releasably connected to the second section 342 by means of the fastening means 342*a*. The plate 343 is slidably accomodated in the first section 341 and can be detachably connected thereto by another fastening means 341*b* which may consist of a screw passing through the first section 341 and one of the threaded holes 343*a* and a nut engagable with the screw. If the screw-nut assembly is employed for the fastening means 341*b*, the holes 343*a* must not be threaded but mere drill holes for accommodating the screw.

The roller skate 40 shown in FIG. 9 is substantially that in FIG. 8, except that the cover member 381 and plate member 343 as shown in FIG. 8 are included in a first section 421 and a second section 422 of a chassis 42. In other words, each rotary or running element 44 is mounted on a fastening means 46 supported at a descending wall portion 421*a* or 422*a* of the first or second section 421 or 422. The front portion of the second section may slidingly be accomodated in the rear portion of the first section 421 and releasably connected by a fastening means 421*b* which may be the same as the fastening means 341*b* for the embodiment shown in FIG. 8.

While the forms or designs of the roller skates described hereinbefore constitute preferred embodiments of the invention, it is to be understood that the invention is not limited to these precise forms of the device, and that changes may be made therein without departing from the scope of the invention which is defined in the appended claims.

I claim:

1. A roller skate, comprising a support, two rotary elements each having a substantially spherical configuration, means for rotatably mounting each of said elements on said support along the longitudinal axis of said support, said mounting means comprising a bolt-nut assembly and each of said rotary elements having a central through bore, the bolt of said bolt-nut assembly extending through said bore to rotatably mount each of said elements, each of said rotary elements comprising a substantially spherical body formed with said central bore and bearing means inserted in said bore, said body comprising a synthetic material and said bearing means being comprised of an oilless graphite-containing alloy, said body being laminated and having an inner layer comprised of ABS resin and an outer layer comprised of rubber means.

2. A roller skate claimed in claim 1, including band means for placing on the roller skate without use of shoes.

3. A roller skate, comprising a support having a descending skirt portion formed with apertures; two rotary bodies, each having a substantially spherical configuration and having a laminated structure formed with a central through bore; bearing means inserted in said bore of said bodies; and a bolt-nut assembly for rotatably connecting each of said bodies to said support, said bodies being arranged on the underside of said support along a longitudinal central axis thereof, by inserting the bolt through said apertures formed in said skirt portion of said support and the bore formed in each of said body, said body having an inner hollow core member made of a ABS resin and an outer rubber member molded on said core member.

* * * * *